US006533559B2

(12) United States Patent
Hsieh

(10) Patent No.: US 6,533,559 B2
(45) Date of Patent: Mar. 18, 2003

(54) HEAT DISSIPATING FAN WITH MULTIPLE LAYERS OF BLADES

(76) Inventor: Hsin-Mao Hsieh, No. 6, East Section, Chiao Nan Li Industrial 6th Rd., Pingtung City (TW)

( * ) Notice: Subject to any disclaimer, the term of this patent is extended or adjusted under 35 U.S.C. 154(b) by 0 days.

(21) Appl. No.: 09/854,217

(22) Filed: May 11, 2001

(65) Prior Publication Data

US 2002/0168277 A1 Nov. 14, 2002

(51) Int. Cl.[7] ..... F04B 17/00

(52) U.S. Cl. ..... 417/423.5; 417/354; 417/423.7; 417/415; 417/220

(58) Field of Search ..... 417/353, 354, 417/423.1, 423.5, 423.7, 423.12, 423.14; 415/199.5, 211.2, 220; 416/198 R

(56) References Cited

U.S. PATENT DOCUMENTS 2,429,733 A * 10/1947 Trent ..... 392/366
3,924,964 A * 12/1975 Lievens et al. ..... 417/423 R
5,297,942 A * 3/1994 Fleishman et al. ..... 417/354
5,393,197 A * 2/1995 Lemont et al. ..... 415/68
5,839,205 A * 11/1998 Hung ..... 417/423.5
6,021,747 A * 2/2000 Gee et al. ..... 123/41.12
6,270,325 B1 * 8/2001 Hseih ..... 417/423.12
6,343,014 B1 * 1/2002 Lin ..... 415/66

* cited by examiner

*Primary Examiner*—Charles G. Freay
*Assistant Examiner*—John F Belena
(74) *Attorney, Agent, or Firm*—Dellett & Walters

(57) ABSTRACT

A heat dissipation fan has a casing, two fans and multiple stationary blades. The fans are co-axially rotatably mounted in the casing. Multiple rotating blades are arranged around the outer periphery of each fan. The stationary blades are secured in the casing and between the rotating blades of the two fans. The angle of the rotating blades on both of the fans is the same. The angle of the stationary blades is perpendicular to that of the passing rotating blades. Accordingly, the airflow generated by the dissipation fan will be enhanced with the multiple layers of rotating blades. The stationary blades reverse the direction of the airflow. The dissipating effect of the dissipation fan is further increased.

4 Claims, 4 Drawing Sheets

HEAT DISSIPATING FAN WITH MULTIPLE LAYERS OF BLADES

BACKGROUND OF THE INVENTION

1. Field of the Invention

The present invention relates to a heat dissipating fan, and more particularly to a heat dissipating fan with multiple layers of blades.

2. Description of Related Art

With reference to FIG. 4, a conventional heat dissipation fan in accordance with the prior art comprises a casing (80), a stator (60) and a fan (70). The fan (70) is rotatably mounted in the casing (80). The stator (60) with an electromagnet (64) and a circuit board (65) is securely mounted in the casing (80). A permanent magnet (72) is mounted in the fan (70) to be a rotor, such that the fan (70) can rotate due to the interaction between the magnetic forces in the stator (60) and the permanent magnet (72). A sleeve (61) pressed into the stator (60), and the sleeve (61) and stator (60) combination is mounted in the casing (80). A shaft (74) extends from the fan (70) and through a bearing (62) pressed into the sleeve (61), such that the fan (70) can rotate relative to the casing (80) with very little friction.

However, because the conventional dissipation fan only has one set of blades, the dissipating efficiency of the conventional dissipation fan is not very good. Especially, when the conventional dissipation fan is used in a crowded or an unventilative environment, the single set of the blades of the conventional dissipation fan cannot effectively cause the air to flow. The scope of using the conventional dissipation fan is limited.

To overcome the shortcomings, the present invention provides an improved heat dissipation fan to mitigate or obviate the aforementioned problems.

SUMMARY OF THE INVENTION

The main objective of the heat dissipating fan with multiple layers of blades in accordance with the present invention is to enhance the heat dissipation effect. The dissipation fan has a casing, two fans and multiple stationary blades. The fans are co-axially rotatably mounted in the casing. Multiple rotating blades are arranged around the outer periphery of each fan. The stationary blades are secured in the casing between the rotating blades of the two fans. Consequently, the airflow generated by the dissipation fan will be enhanced with the multiple layers of blades.

Other objects, advantages and novel features of the invention will become more apparent from the following detailed description when taken in conjunction with the accompanying drawings.

DETAILED DESCRIPTION OF PREFERRED EMBODIMENT

Figure 1:
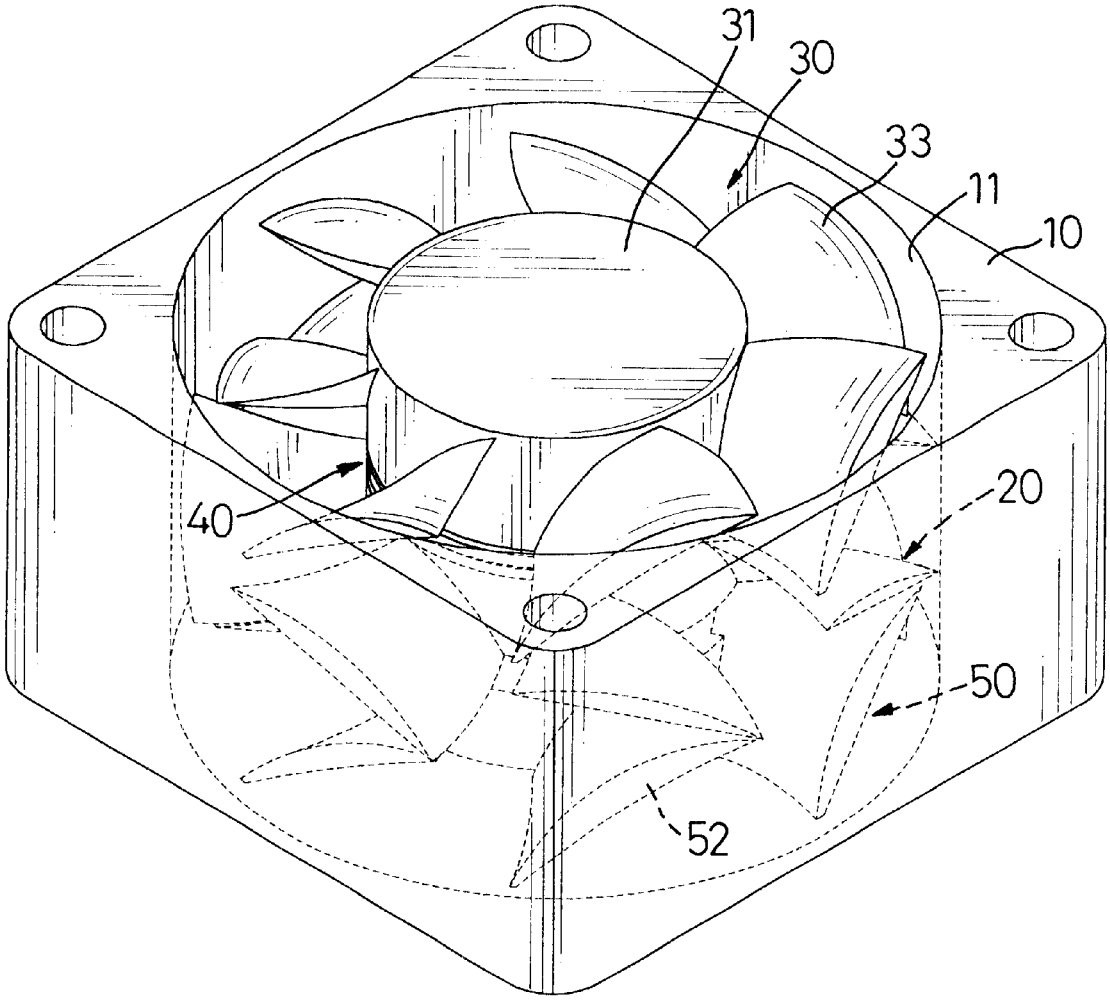
FIG. 1 is a perspective view of a heat dissipation fan in accordance with the present invention.
Figure 2:
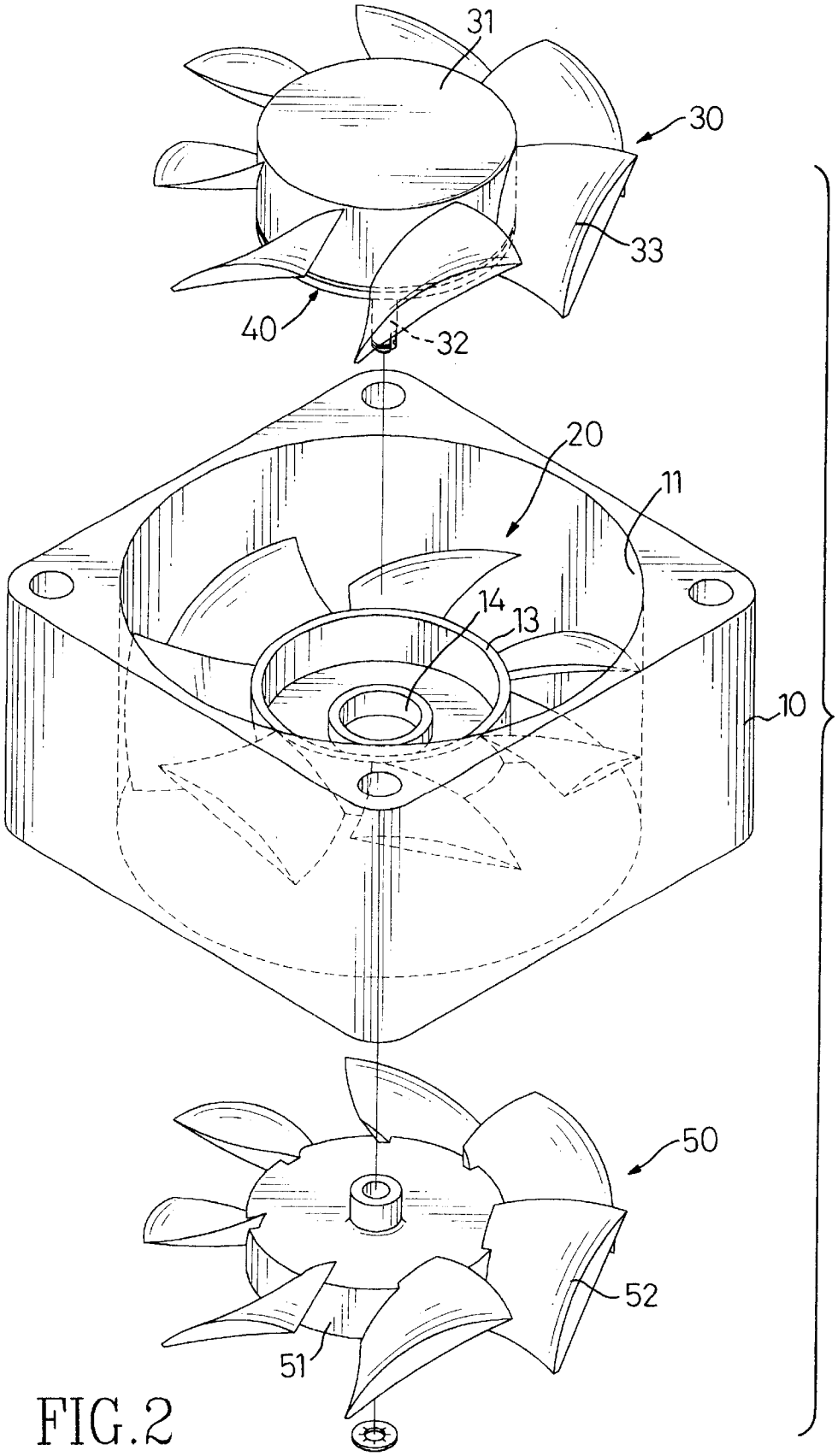
FIG. 2 is an exploded perspective view of the heat dissipation fan in FIG. 1.

With reference to FIGS. 1 and 2, a heat dissipation fan in accordance with the present invention comprises a casing (10), multiple stationary blades (20) and two fans (30,50). A passage (11) is defined through the casing (10) to receive the fans (30,50). A base (13) with a through hole (14) is formed in the middle of the casing (10). The stationary blades (20) are mounted in the casing (10) and connected between the inner face of the passage and the base (13).

Figure 3:
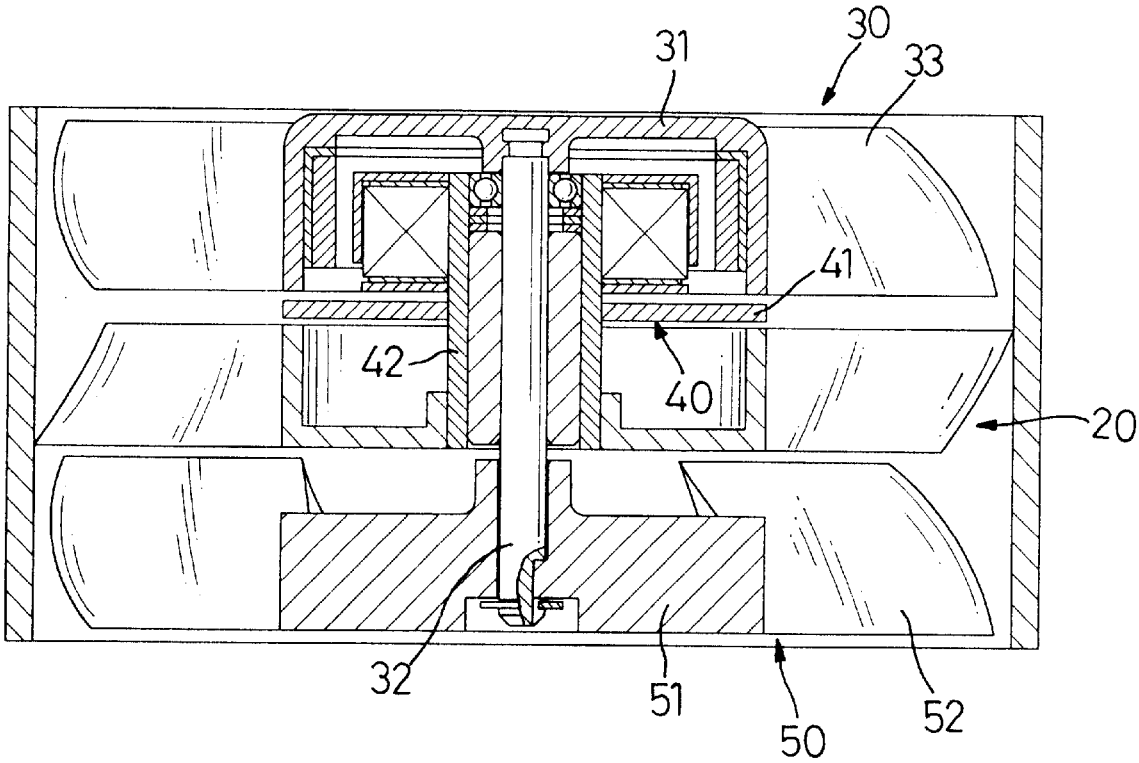
FIG. 3 is a side plan view in partial section of the heat dissipation fan in FIG. 1.
Figure 4:
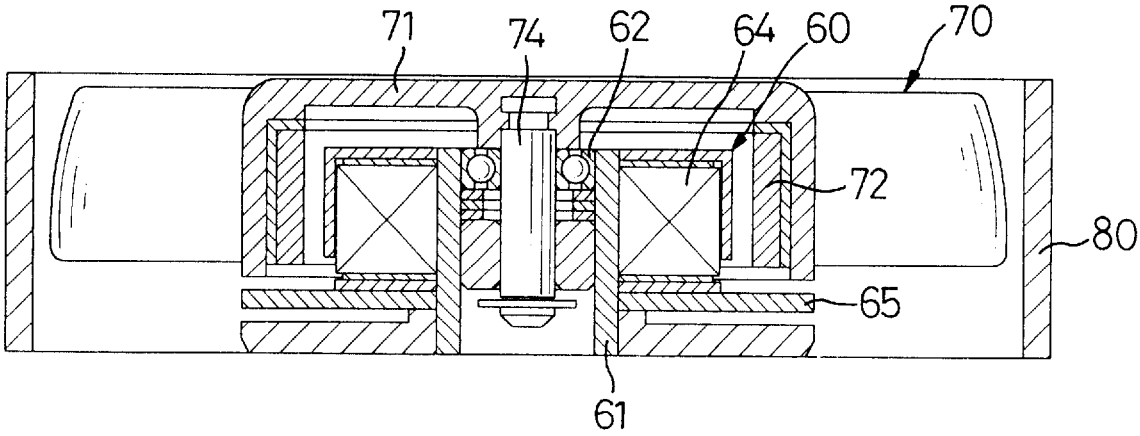
FIG.4 PRIOR ART
FIG. 4 is a side plan view in partial section of a conventional heat dissipation fan in accordance with the prior art.

With reference to FIGS. 2 and 3, a stator (40) is securely mounted in the casing (10) with a sleeve (42). A circuit board (41) is attached to the stator (20). The sleeve (42) has two ends and one end is inserted into the through hole (14) in the base (13). A bearing (not numbered) is securely mounted in the other end of the sleeve (42).

The two fans (30, 50) are co-axially rotatably mounted in the casing (10) and are respectively located on opposite sides of the stationary blades (20). Each fan (30, 50) has multiple rotating blades (33, 52) arranged around the outer periphery of a rotating base (31, 51). The angle of the rotating blades (33, 52) is the same on both fans (30, 50). The angle of each stationary blade (20) is essentially perpendicular to that of a passing rotating blade (33, 52). A permanent magnet (not numbered) is mounted in the one of the fans (30) to be the rotor. A shaft (32) extends from one of the fans (30) through a passage defined in the bearing and the sleeve (42). A longitudinal keyway (not numbered) is formed in the shaft (32) at he distal end. A corresponding key (not numbered) is formed on an inner periphery of a central hole (not numbered) through the other fan (50). The other an (50) is secured to the end of the shaft (32) extending out from the sleeve (42). A locking disk (not numbered) securely engage the shaft (32) to hold the fan (50) on the shaft (32), such that the fans (30, 50) rotate simultaneously.

In operation, with reference to FIGS. 1 to 3, the fans (30, 50) simultaneously rotate due to the interaction between the stator (40) and the permanent magnet in the fan (30). The rotating blades (33, 52) will cause the air to flow so as to provide a dissipating effect. Because two sets of rotating blades (33, 52) are used to move the air, the airflow can be enhanced and a good dissipating effect is provided. The stationary blades (20) between the rotating blades (33, 52) change the direction of the air discharged from the first fan since the stationary blades (20) are essentially perpendicular to the passing rotating blades (33, 52). Consequently, the second set of blades imparts energy to the moving air more efficiently, and the volume of air flowing through the dissipating fan is increased. The dissipating effect of the dissipation fan is further increased.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat dissipation fan comprising:

a hollow casing;

a first fan with multiple first rotating blades arranged around an outer periphery of the first fan and a second fan co-axially rotatably mounted with the first fan in the casing and having multiple second rotating blades arranged around an outer periphery of the second fan; and multiple stationary blades mounted in the casing between the first rotating blades and the second rotating blades so as to enhance the air flow generated by the dissipation fan, wherein each first rotating blade has a pitch angle the same as that of each second rotating blade and perpendicular to the pitch angle of each stationary blade.

2. The dissipation fan as claimed in claim 1, wherein a sleeve is secured in the casing;

a stator is fit on the sleeve;

a bearing is mounted in the sleeve;

a permanent magnet is attached to the first fan to be a rotor;

a shaft extends from the first fan and through a passage defined through the bearing and the sleeve;

the second fan is secured to the shaft at an end extending through the sleeve by a longitudinal keyway on the shaft and a key on the inner surface of a central hole through the second fan so as to co-axially connect the second fan to the first fan.

3. The dissipation fan as claimed in claim 2, wherein a passage is defined through the casing to receive the first and second fans;

a base with a through hole is formed in a middle of the casing so the sleeve can be inserted into the through hole; and the stationary blades are connected between the inner face of the passage and the base so as to fix the stationary blades to the casing.

4. The dissipation fan as claimed in claim 2, wherein a locking disk securely engages the shaft to hold the second fan on the shaft.

* * * * *